United States Patent [19]

Griffith

[11] Patent Number: 4,784,269

[45] **Date of Patent: * Nov. 15, 1988**

[54] PACKAGING WRAP

[76] Inventor: William R. Griffith, 685 Converse Dr., Cincinnati, Ohio 45240

[ * ] Notice: The portion of the term of this patent subsequent to Oct. 20, 2004 has been disclaimed.

[21] Appl. No.: 931,297

[22] Filed: Nov. 14, 1986

Related U.S. Application Data

[63] Continuation-in-part of Ser. No. 744,927, Jun. 14, 1985, Pat. No. 4,700,844.

[51] Int. Cl.[4] ..... B65D 25/10; B65D 85/48

[52] U.S. Cl. ..... 206/453; 206/586; 493/69

[58] Field of Search ..... 206/586, 453, 454, 523, 206/587, 588, 396, 397; 229/DIG. 1; 493/69, 70, 78, 396, 397; 428/155, 156; 156/581, 211, 258, 304.5

[56] References Cited

U.S. PATENT DOCUMENTS

| | | | |
|---|---|---|---|
| 2,160,221 | 5/1939 | Masters et al. | 206/586 |
| 2,196,157 | 4/1941 | White | 206/586 |
| 2,692,720 | 10/1954 | Suess et al. | 206/586 |
| 2,746,667 | 5/1956 | Murphy | 206/454 |
| 3,192,099 | 6/1965 | Beckman et al. | 428/71 |
| 3,235,432 | 2/1966 | George | 156/211 |
| 3,285,800 | 11/1966 | Bartell et al. | 206/523 |
| 3,337,111 | 8/1967 | Petriekis et al. | 206/586 |
| 3,339,722 | 9/1967 | Van Antwerpen | 206/453 |
| 3,352,741 | 11/1967 | Miller | 428/160 |
| 3,362,609 | 1/1968 | Freedy | 206/587 |
| 3,446,685 | 5/1969 | Goldstone et al. | 428/160 |
| 3,456,701 | 7/1969 | Cornell | 156/258 |
| 3,530,213 | 9/1970 | Belle Isle | 206/523 |
| 3,768,724 | 10/1973 | Hill | 229/481 |
| 3,780,929 | 12/1973 | Terrasi | 206/586 |
| 3,812,002 | 5/1974 | Lurie | 156/220 |
| 3,929,536 | 12/1975 | Maughan | 229/DIG. 1 |
| 4,162,729 | 7/1979 | Kaiser et al. | 229/DIG. 1 |
| 4,386,925 | 6/1983 | Focke | 493/396 |
| 4,642,086 | 2/1987 | Howarth, JR. | 493/396 |

FOREIGN PATENT DOCUMENTS

| | | | |
|---|---|---|---|
| 697347 | 11/1964 | Canada | 493/397 |
| 30097 | 6/1981 | European Pat. Off. | 493/68 |
| 6284058 | 3/1963 | Switzerland | 493/70 |
| 793632 | 4/1958 | United Kingdom | 156/220 |

*Primary Examiner*—Jimmy G. Foster
*Attorney, Agent, or Firm*—Kirkland & Ellis

[57] ABSTRACT

A packaging wrap of a paper and shock absorbing material combination in which the lower layers are cut at specified distances from the edges of the wrap to form strips, while the uncut layer provides hinges about which the strips rotate until lying flat upon the uncut layer, where such strips are secured in position. Because the width of each strip is less than one-half the width of the wrap, a hollow gap is formed in which all or a portion of an article may be inserted. The flexibility of the wrap is increased by crimping the wrap along lines substantially perpendicular to the length of the wrap at intervals along the length of the wrap.

12 Claims, 3 Drawing Sheets

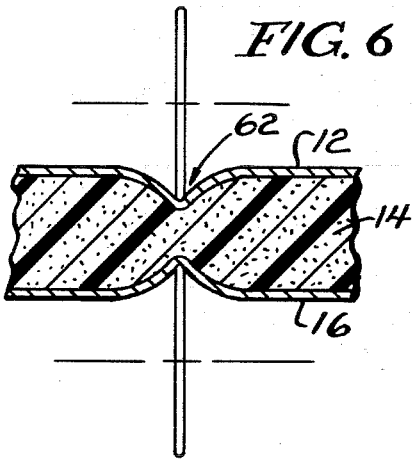
FIG. 6
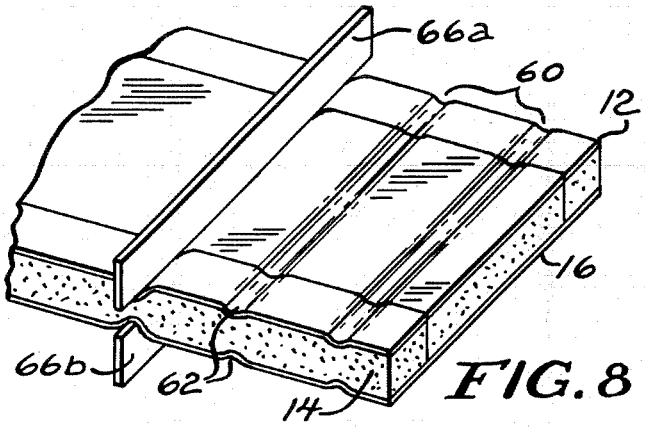
FIG. 8
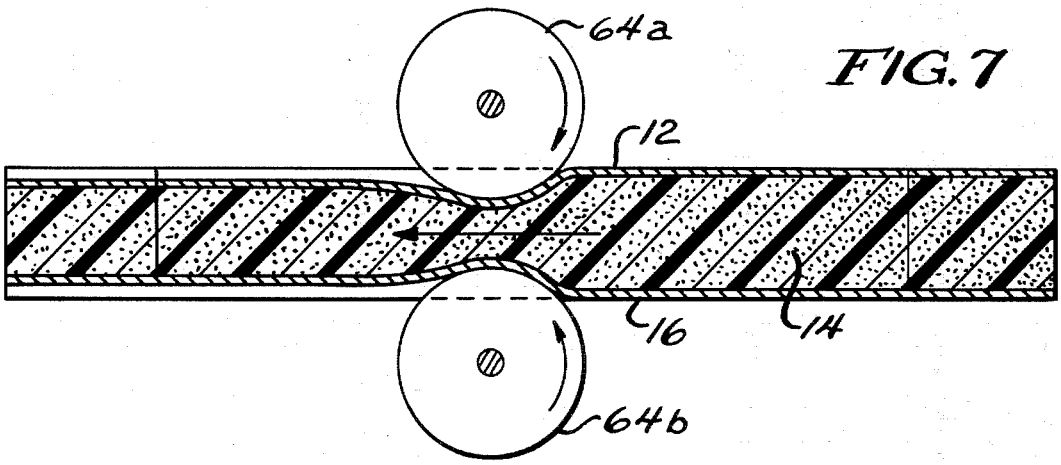
FIG. 7
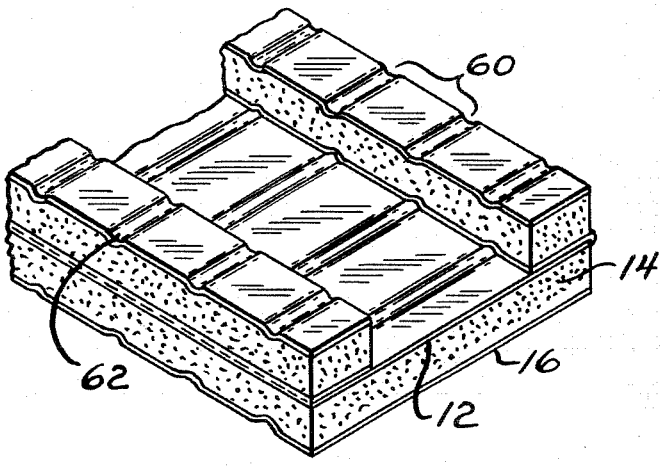
FIG. 9
FIG. 10
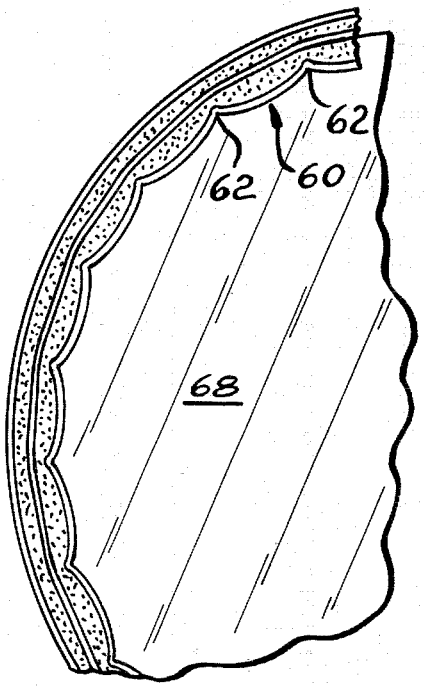

PACKAGING WRAP

BACKGROUND OF THE INVENTION

This is a continuation-in-part of patent application Ser. No. 744 927, filed June 14, 1985, U.S. Pat. No. 4,700,844.

1. Field of Invention

This invention relates generally to packaging products and more particularly to laminated paper and shock absorbing material (or laminated polyethylene sheeting and shock absorbing material) packaging products which provide cushioning and clearance and also support and protection for articles in storage and transit.

2. Description of the Prior Art

A variety of protective packaging products are used in the shipping industry and in other industries to provide cushioning and clearance for articles in transit. For example, Petriekis, U.S. Pat. No. 3,337,111, discloses two separate web units of corrugated paperboard which are bonded together adhesively, scored, and folded to provide a protective corner post. Terrasi, U.S. Pat. No. 3,780,929 discloses a corner post construction in which a corrugated, laminated packing material is cut part way through and folded back on itself, with the uncut portion acting as a hinge. The claims require ply members of flat stiff corrugated sheet material. In addition, the patent suggests that the corrugations extend in a certain direction. A protective coating is applied to at least some of the edges of the corner post to protect the article from debris and the abrasiveness of the edge. Such a coating is less likely to be needed in the present invention. Suess. U.S. Pat. No. 2,692,720 also discloses corrugated packaging materials folded to provide corner protection: the claims require a multi-layered corrugated fiberboard sheet material. The design and shape of the object disclosed in Suess also differs from the present invention. Freedy, U.S. Pat. No. 3,362,609, appears to disclose a cushioning and packaging strip of at least two plies and which is peaked and slotted to provide edge protection. In its brochure on Sus-rap, it appears that linerboard is used. Freedy varies the slot widths and the thickness of the plies to accommodate various articles. The design and construction of the Freedy wrap is different from that of the present invention, because, for one reason, in the Freedy wrap the article rests upon the knocked-down material used in its construction of the top layer of the product, not upon the "base" of the wrap. Similarly, Bartell, U.S. Pat. No. 3,285,800, and Hill. U.S. Pat. No. 3,768,724 disclose the use of laminated cushioning sheets and bags, respectively, to protect articles in transit.

The present invention uses laminated paper and shock absorbing material (or laminated polyethylene sheeting and shock absorbing material) wrap where strips of the wrap are made by severing two layers of the wrap at distances from two edges of the wrap, making a hinge of the uncut layer, and folding the strips back to lie flat on the uncut layer of the wrap. A gap in which all or a portion of at least one article may rest while in storage or transit is thus provided. The article, or portion thereof protected, rests partially upon the base of the wrap when it is in the gap. Moreover, at least the layer of shock absorbing material is continuous, and the materials of construction have varying weights and/or thicknesses so as to accommodate different articles. The permissible variance in the construction materials of the present invention is probably greater than the variance in Freedy's Sus-rap as apparently only the liner board (and coating thereto) could be adjusted. The foregoing list of differences between the present invention and the prior art is not intended to be exhaustive.

SUMMARY OF THE INVENTION

The present invention comprises a wrap formed from a laminated sheet consisting of a continuous layer of a shock absorbing material between top and bottom layers in which the bottom layer and the layer of shock absorbing material are cut at distances from the respective edges to form strips. The uncut top layer provides hinges to allow the strips to rotate until the top layer of the strips lies flat upon the center portion of the uncut, top layer. The two layers are then secured together by an appropriate adhesive. Because the width of each strip is less than one half the width of the full sheet, a gap is formed on top of the sheet between the two opposing edges of folded-over strips. In this gap, a portion or all of an article to be stored or transported can be inserted. The combination of the shock absorbing material and top and bottom layers provides support and protection and also cushioning and clearance for the article while it is in storage or transit. Variations in the weight and composition of the three layers and in the thickness and the density of the shock absorbing material allow articles of varying weights to be shipped with the desired cushioning and clearance. In addition, the dimensions of the sheet and two edge strips which are cut can be selected to form gaps dimensioned to fit various products.

In order to increase the flexibility of the wrap of the present invention, the wrap is crimped along lines substantially perpendicular to the length of the wrap. The crimping can be done either before or after the edges are folded over to produce the gap. The crimping is done with sufficient force to crush the wrap at least partially along each crimp line, thereby facilitating the folding or bending of the wrap along each crimp line. In the preferred embodiment, the wrap is crimped from both sides at regular intervals, the length of the intervals being selected to provide the desired degree of flexibility. This facilitates folding or bending the wrap in either direction.

It is an object of this invention to provide a reliable form of packaging for the cushioning, support, and clearance of all or a portion of at least one article in storage or transit.

It is an object of this invention to provide a form of packaging which may be flexible enough to cause one packaging wrap to provide support cushioning, and clearance for all or a portion of at least one article in storage or transit.

It is a further object of the present invention to provide a packaging wrap which alone, or in combination with at least one other packaging wrap, will provide support, cushioning and clearance for all or a portion of at least one article in storage or transit.

It is an object of this invention to provide a packaging wrap which may use a continuous piece of shock absorbing material as one of the layers of the packaging wrap.

These and other objects, advantages, and features shall hereinafter appear, and for purposes of illustration, but not for limitation, an exemplary embodiment of present invention is illustrated in the accompanying drawings.

BRIEF DESCRIPTION OF THE DRAWINGS

FIG. 6 is a cross-sectional view looking in a direction substantially perpendicular to the length of the packaging wrap and illustrating the formation of a crimp line;

FIG. 7 is a cross-sectional view looking in a direction substantially parallel to the length of the packaging wrap and showing schematically the use of disks for creating crimp lines in the packaging wrap;

FIG. 8 is a perspective view showing schematically the use of straight blades for creating crimp lines in the packaging wrap:

FIG. 9 is a perspective view of the packaging wrap having regularly spaced crimp lines: and FIG. 10 is a side view illustrating how the packaging wrap is folded along crimp lines to follow a curved surface of an object to be protected.

DETAILED DESCRIPTION OF THE PREFERRED EMBODIMENT

Figure 1:
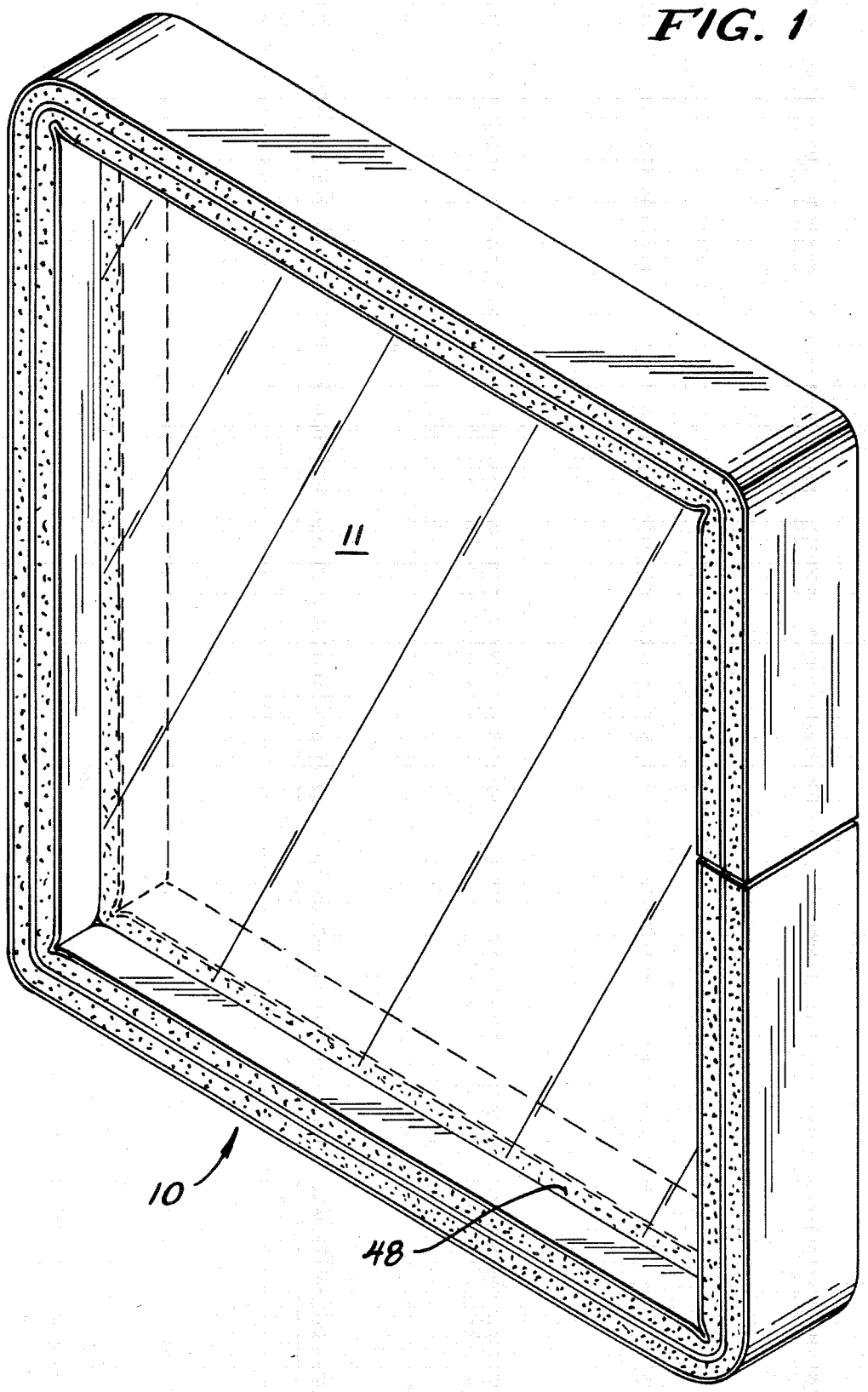
FIG. 1 is a perspective view of the preferred embodiment of the present invention depicting the perimeter of a sheet of glass mounted in the gap of one wrap.

FIG. 1 depicts one packaging wrap 10 being used to cushion and protect the perimeter of a sheet of glass.

Figure 2:
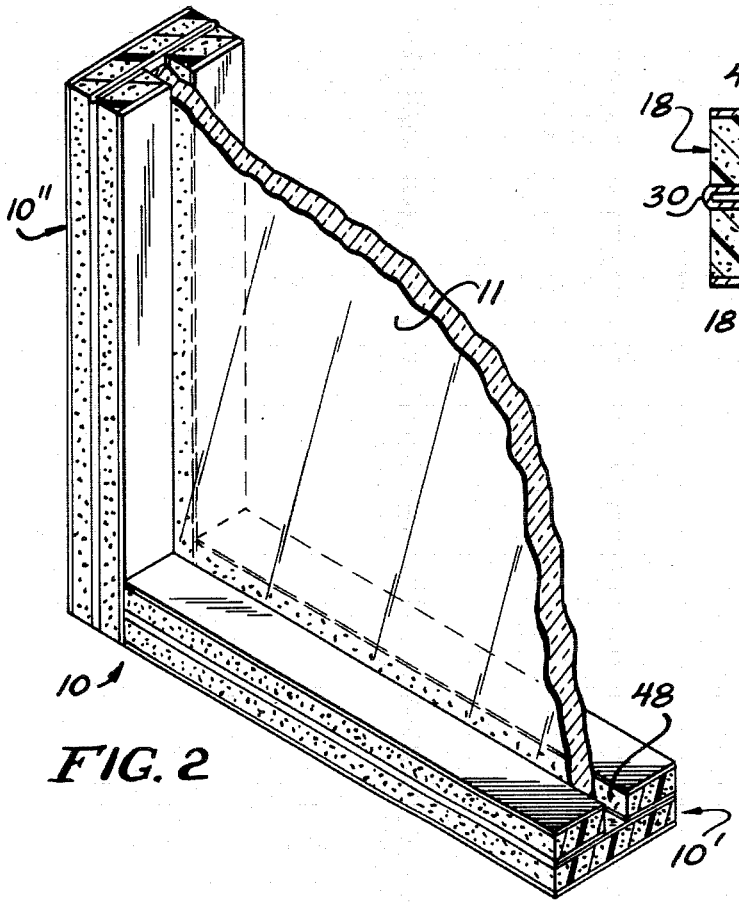
FIG. 2 is a perspective view of the preferred embodiment of the present invention depicting a portion of the perimeter of a sheet of glass mounted in the gap of two sections of the wrap (or one wrap with a portion thereof removed;)
Figure 3:
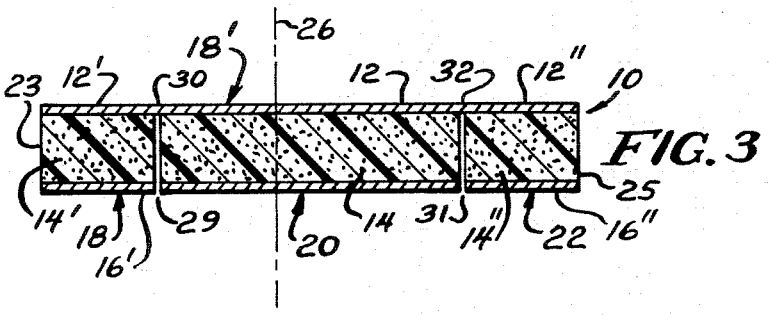
FIG. 3 is a front view of the preferred embodiment of the present invention with the two edge cuts made to form the two edge strips.

FIG. 2 depicts an assembly of two sections 10' and 10'' of wrap 10 used to support and protect a sheet of glass. As shown in FIG. 3, the packaging wrap 10 consists of a top layer 12, made of paper, polyethylene or another suitable material, a middle layer 14, made of polystyrene or suitable material for absorbing shocks and providing limited structural support, and a bottom layer 16, which can be of the same material as top layer 12. The packaging wrap 10 is made by using a cylindrical mold (not shown) which allows the middle layer 14 to be peeled off (somewhat like peeling an apple) at a desired thickness to provide a continuous length of the shock absorbing material. The middle layer 14 is then laminated to the layers 12 and 16. The top and bottom layers 12 and 16 may also be continuous. The continuity-type of fabrication is opposed to a fabrication in a precise length or "block" form of standard length. Because it is continuous, the length of the wrap is adjustable so as to accommodate all or a portion of the perimeters of various articles. The continuous nature of the layer allows for standardization of lengths, if so desired. The lengths could be substantially equal to the perimeter of an article.

The gap 48 (see FIGS. 2 and 5) is formed by cutting bottom layer 16 and middle layer 14 and folding top layer 12. First, the bottom layer 16 and the middle layer 14 are cut, not necessarily parallel to the edges 23, 25, at distances from each edge 23 and 25, respectively, of wrap 10 to form a left panel 18 (comprised of top layer 12', middle layer 14', and bottom layer 16'), a center base 20, and the right panel 22 (comprised of top layer 12'', middle layer 14'', and bottom layer 16''). Left and right hinges 30 and 32 are formed by the portions of uncut top layer 12 adjacent to cuts 29 and 31, respectively. The top layer 12, although unsevered, is thus divided by the hinges 30 and 32 into the left top layer 12', the top layer 12, and the right top layer 12''. Substantially none of the several layers are removed during this cutting operation.

Figure 4:
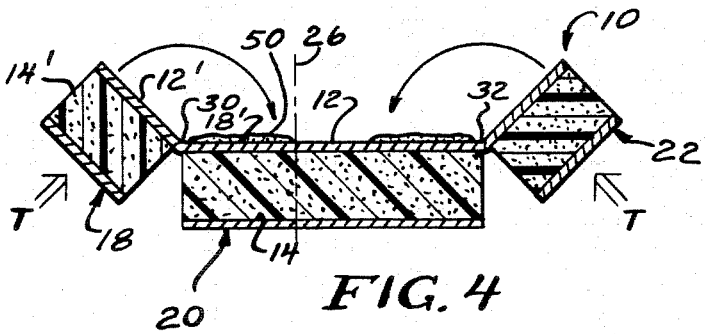
FIG. 4 is a front view of the preferred embodiment of the present invention depicting the rotating of the two edge strips of the wrap into their assembled position.

Then, as illustrated in FIG. 4, a torque T is exerted on left panel 18 to rotate it about left hinge 30 until top layer 12' lies substantially flat against top layer 12 of center base 20. A similar torque is exerted with similar results on the right panel 22. Left panel 18 and right panel 22 can then be bonded with a suitable adhesive 50, to top layer 12 of base 20.

Figure 5:
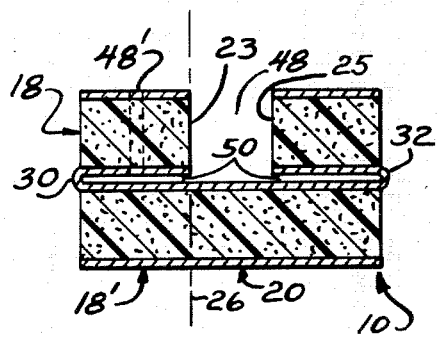
FIG. 5 is a front view of the preferred embodiment of the present invention in its fully assembled state.

Because the widths of left panel 18 and right panel 22, respectively, are each less than one half the width of the packaging wrap 10, there is a gap 48 between the outside edges 23 and 25 of said panels when rotated over on top of center base 20 as depicted in FIG. 5. Depending upon the dimensions of the wrap, all or a portion of the perimeter (for example) of an article may be inserted into gap 48.

With reference to FIGS. 6–10 in the preferred embodiment the packaging wrap 10 is crimped from both sides at regular intervals 60 in order to score the outer layers of paper 12 and 16 and crush the middle layer 14. This crimping step is most beneficial when middle layer 14 is comprised of polystyrene or other material that is relatively stiff, but that can be rendered more flexible by crushing along crimp lines 62. The wrap is more easily folded or bent along crimp lines 62, thereby enhancing the flexibility of the wrap 10. The sharper the angle of a contour that wrap 10 is intended to follow (i.e., the smaller the object wrap 10 will be wrapped around), the closer together crimp lines 62 can be spaced. In the preferred embodiment, crimp lines 62 are made by passing wrap 10 between opposing wheel members **64*a* and 64*b* (See FIG. 7). Other suitable means, such as pinching wrap 10 between two blade members 66*a* and 66*b* (see FIG. 8), also can be used. In some applications, sufficient flexibility may be achieved by crimping from only one side of wrap 10. However, experience has shown that superior results are achieved by crimping from both sides at regular intervals. FIG. 9 illustrates a length of wrap 10 having crimp lines 62 at intervals 60, and FIG. 10 illustrates the use of such wrap 10 to package a contoured object 68**.

A second embodiment of the present invention is shown by the porions of FIGS. 3, 4, and 5, to the right of dashed line 26. The second embodiment can be formed in a manner similar to the formation of the first embodiment: by severing wrap 10 through the bottom layer 16 and middle layer 14. The top layer 12 remains uncut to provide a hinge. Two equal panels are thus formed, the left panel 18 and the right panel 18', each consisting of a top layer 12 and 12', respectively, a middle layer 14 and 14', respectively, and a bottom layer 16 and 16' respectively. As depicted in FIG. 4, a torque is exerted to rotate the left panel 18 about the hinge 30 so that tp layer 12' lies substantially flat against top layer 12. The panels can then be bonded together with a suitable adhesive 50. A gap 48' of desired dimension (shown schematically) is then removed from the right panel 18.

A third embodiment of the invention is shown to the right of dashed line in FIG. 3. Only right cut 31 is made and only the right panel 22 is formed and subsequently rotated to form a curb. Thus, in this third embodiment, a curb 25 is formed rather than a gap and the article is cushioned against surface 12 and 25. (The same operation could be performed on the left side of the wrap only.)

The present invention, as depicted in the accompanying illustrations, is used to wrap a portion of or all of the perimeter of an article. However, the invention may also be used to protect other portions of the article or all of an article by appropriately dimensioning the packaging wrap 10 and the gap 48 therein.

The dimensions of the present invention also can be adjusted to accommodate the various sizes and weights of articles with which the invention is to be used to meet the applicable regulations concerning their packaging (i.e., the required clearance or distance between the product and the inside of the container in which it is packaged). The gap 48 may be widened or narrowed, the weight of the paper used can be increased or decreased, and the thickness and density of the shock absorbing material can be increased or decreased. In addition, other materials, such as polyethylene can form the top layer 12 or the bottom layer 16. The preferred weights of paper vary from crepe (defined herein as the lightest weight of paper) up to 90 pounds or more. Fiberboard is one of the many alternatives with the preferred weights. The increase in the weight of the paper increases the strength of the packaging wrap. The preferred thickness of the polyethylene ranges from approximately 1 mil to 6 mil. The preferred density of the shock absorbing material is between one half to two pounds per cubic foot, but other densities will also suffice. Polystyrene is one of many shock absorbing materials which may be used. The bonding agent used to secure the left panel 18 and the right panel 22 to top layer 12 must be one that is compatible with both the shock absorbing material and the other layer(s). A water-based glue, for example, is a suitable adhesive for use with paper and polystyrene. The same adhesive may also be used with polystyrene and polyethylene. The materials making up the layers may be, but need not be, flexible, depending upon the use to which the wrap will be put. Where one wrap or more than one wrap is used the wraps may be connected by tape for example.

It is to be understood that while the preferred embodiment of the invention has been illustrated and described, the present invention is not limited to the precise construction herein disclosed. For example, in any of the embodiments discussed above, the bottom layer of paper or polyethylene sheeting could be omitted and only the layer of shock absorbing material cut; the strip(s) folded back as described above, and the resulting packaging wrap would remain within the scope of this invention.

Additionally, the invention encompasses the packaging wrap itself, without regard to the manner in which it is formed. It covers as well methods not depicted in the drawings. Thus, it covers two sections, each having one, two, or three layers, arranged so that one surface of one section is in contact with one surface of the other, and a portion of at least one section is removed to form a gap. It covers two sections, each consisting of one, two, or three layers, arranged so that the one surface of one section is in contact with one surface of the other section, where the width of one section is less than the width of the other section, whereby a curb is formed. It also covers a packaging wrap made up of three sections, each having one, two, or three layers, wherein one surface of two of the sections are in contact with one surface of the third section. but wherein the first two sections are not in contact with each other, whereby a gap is formed. These embodiments would appear similar to those previously discussed except that the hinge (or hinges) 30 (or 30 and 32) would probably not be present and more of the base section (20) may be removed. It also includes embodiments where only one section (of one, two, or three layers) is formed, and a portion thereof is removed to form a gap or curb, and where a wrap or section uses, for example, two layers of shock absorbing material and only one of paper or polyethylene. In addition, any of the foregoing embodiments could be fabricated from section(s) consisting of only a single layer, more than three layers, or more than two sections.

The invention could be used to support and protect the perimeter (or portion(s) thereof) of two or more objects grouped together as well as individual objects or portions thereof. The present invention also includes using one or more than one wrap to protect the perimeter of at least one article by enclosing the perimeter of at least one article. Other changes, modifications, and variations can be made without departing from the scope and spirit of the present invention. The right is reserved to all changes and modifications coming within the scope of the invention as defined in the appended claims.

Finally, the invention encompasses the combination of the methods and/or wraps previously discussed, e.g., severing a portion of the wrap to form one edge section and attaching a suitable piece to form a gap. Nor would the spirit of the invention be avoided by inserting, for example, some additional, but unattached layer, between the surfaces or the layers which were to be in contact with each other, substantially flat against each other.

I claim:

1. A method of constructing a packaging wrap for supporting and protecting at least one article, which method comprises:

bonding a first layer of flexible material to a first major surface of a layer of shock absorbing material, the layer of shock absorbing material having first and second parallel edges along two sides of the first major surface;

severing the layer of shock absorbing material along a cutting line, the cutting line being parallel to the first and second parallel edges of the layer of shock absorbing material, and the distance between the cutting line and the first parallel edge of the layer of shock absorbing material being less than the distance between the cutting line and the second parallel edge of the layer of shock absorbing material;

folding the first layer of flexible material along a fold line located directly over the cutting line so as to fold a portion of the first layer of flexible material back on itself and to rotate the portion of the shock absorbing material between the cutting line and its first edge over onto the first layer of flexible material, whereby a curb is formed by the first edge of the shock absorbing material over the portion of the shock absorbing material between the cutting line and the second edge; and crimping the shock absorbing material along crimp lines transverse to the first and second cutting lines to facilitate the bending of the packaging wrap along the crimp lines.

2. A method of constructing a flexible packaging wrap for supporting and protecting at least one article, which method comprises:

bonding a first layer of flexible material to a first major surface of a layer of flexible, shock absorbing material, the layer of flexible, shock absorbing material having first and second parallel edges along two sides of the first major surface;

severing the layer of flexible, shock absorbing material along a cutting line, the cutting line being parallel to the first and second parallel edges of the layer of flexible, shock absorbing material, and the distance between the cutting line and the first parallel edge of the layer of flexible, shock absorbing material being less than the distance between the cutting line and the second parallel edge of the layer of flexible, shock abosrbing material;

folding the first layer of flexible material along a fold line located directly over the cutting line so as to fold a portion of the first layer of flexible material back on itself and to rotate the portion of the flexible, shock absorbing material between the cutting line and its first edge over onto the first layer of flexible material, whereby a curb is formed by the first edge of the flexible, shock absorbing material over the portion of the flexible, shock absorbing material between the cutting line and the second edge; and crimping the shock absorbing material along crimp lines transverse to the first and second cutting lines to facilitate the bending of the packaging wrap along the crimp lines.

3. A method of constucting a packaging wrap for supporting and protecting at least one article, wiich method comprises:

bonding a first layer of flexible material to a first major surface of a layer of shock absorbing material, the layer of shock absorbing material having first and second parallel edges along two sides of the first and second major surface;

severing the layer of shock absorbing material along first and second cutting lines, the first and second cutting lines being parallel to the first and second parallel edges of the layer of shock absorbiing material, and the distance between the first cutting line and the first parallel edge of the layer of shock absorbing material plus the distance between the second cutting line and second parallel edge of the layer of shock absorbing material being less than the distance between the first and second cutting lines;

folding the first layer of flexible material along a first fold line located directly over the first cutting line so as to fold a first portion of the first layer of flexible material back on itself and to rotate the portion of the shock absorbing material between the first cutting line and its first edge over onto the first layer of flexible material;

folding the first layer of flexible material along a second fold line located directly over the second cutting line so as to fold a second portion of the first layer of flexible material back on itself and to rotate the portion of the shock absorbing material between the second cutting line and its second edge over onto the layer of flexible material, whereby a gap is formed between the first and second edges of the shock absorbing material over a portion of the shock absorbing material between the first and second cutting lines; and crimping the shock absorbing material along crimp lines transverse to the first and second cutting lines to facilitate the bending of the packaging wrap along the crimp lines.

4. The method as claimed in claim 1 or 3 wherein the crimp lines are spaced at regular intervals.

5. The method as claimed in claim 1 or 3 wherein the crimping is accomplished by rolling first and second opposing wheel members across the packaging wrap with the packaging wrap pinched between them.

6. The method as claimed in claim 1 or 3 wherein the crimping is accomplished by pressing first and second opposing crimp blades toward each other with the packaging wrap pinched between them.

7. The method as claimed in claim 1 or 3 wherein the shock absorbing material is crimped along crimp lines on the first major surface thereof.

8. The method as claimed in claim 1 or 3 wherein the shock absorbing material is crimped along opposing crimp lines on the first and second major surfaces thereof.

9. A packaging wrap for supporting a fragile article and comprising:

a first longitudinal planar strip of shock absorbing material;

a first longitudinal planar strip of flexible material superimposed on said first strip of shock absorbing material said first strip of flexible material and said first strip of shock absorbing material being bonded together in face-to-face relation to form a longitudinal laminated structure; and said longitudinal laminated structure having a first ridge formed by severing said first strip of shock absorbing material along a first longitudinal cutting line and rotating the portion of said first shock absorbing material between a first edge of said first strip of shock absorbing material and the first cutting line in a first direction over onto two thicknesses of said first strip of flexible material by folding said first strip of flexible material along the first longitudinal cutting line; and wherein said longitudinal laminated structure is crimped along crimp lines transverse to the length thereof to facilitate the bending of the packaging wrap along the crimp lines.

10. The packaging wrap as claimed in claim 9 wherein the crimp lines are spaced at regular intervals.

11. A flexible, packaging wrap for supporting a fragile article and comprising:

a first longitudinal planar strip of flexible, shock absorbing material;

a first longitudinal planar strip of flexible material superimposed on said first strip of flexible, shock absorbing material, said first strip of flexible material and said first strip of shock absorbing material being bonded together in face-to-face relation to form a flexible, longitudinal, laminated structure; and said flexible, longitudinal, laminated structure having a first ridge formed by severing said first strip of flexible, shock, absorbing material along a first longitudinal cutting line and rotating the portion of said first strip of flexible, shock absorbing material between a first edge of said first strip of flexible, shock absorbing material and the first cuttiing line in a first direction over onto two thicknesses of said first strip of flexible material by folding said first strip of flexible material along the first longitudinal cutting line, wherein said flexible, longitudinal, laminated structure is crimped along crimp lines transverse to the length thereof to facilitate the bending of the packaging wrap along the crimp lines.

12. A packaging wrap for supporting a fragile article and comprising:

a first longitudinal planar strip of shock absorbing material;

a first longitudinal planar strip of flexible material superimposed on said first strip of shock absorbing material, said first strip of flexible material and said first strip of shock absorbing material being bonded together in face-to-face relation to form a longitudinal laminated structure;

a second longitudinal planar strip of flexible material superimposed on said first strip of shock absorbing material on the face opposite from said first strip of flexible material, wherein said second strip of flexible material and said first strip of shock absorbing material are bonded together in face-to-face relation; and said longitudinal laminated structure having a first ridge formed by severing said first strip of shock absorbing material and said second strip of flexible material along a first longitudinal cutting line and rotating the portion of said first strip of shock absorbing material and said second strip of flexible material between a first edge thereof and the first cutting line in a first direction over onto two thicknesses of said first strip of flexible material by folding said first strip of flexible material along the first longitudinal cutting line, said longitudinal structure having a second ridge formed by severing said first strip of shock absorbing material and said second strip of flexible material along a second longitudinal cutting line and rotating the portion of said first strip of shock absorbing material and said second strip of flexible material between a second edge thereof and the second cutting line in a second direction over onto two thicknesses of said first strip of flexible material by folding said first strip of flexible material along the second longitudinal cutting line, wherein said longitudinal laminated structure is crimped along crimp lines transverse to the length thereof to facilitate the bending of the packaging wrap along the crimp lines.

* * * * *

UNITED STATES PATENT AND TRADEMARK OFFICE

CERTIFICATE OF CORRECTION

PATENT NO. : 4,784,269

DATED : November 15, 1988

INVENTOR(S) : William R. Griffith

It is certified that error appears in the above-identified patent and that said Letters Patent is hereby corrected as shown below:

Column 1, line 6, "744 927" should read --744,927--.

Column 1, line 34, "Suess." should read --Suess,--.

Column 1, line 51, "Hill." should read --Hill,--.

Column 2, line 53, "support" should read --support,--.

Column 2, line 59, "cushioning" should read --cushioning,--.

Column 3, line 12, "removed;)" should read --removed);--.

Column 3, line 30, "wrap:" should read --wrap;--.

Column 3, line 32, "lines:" should read --lines;--.

Column 4, line 27, "6-10" should read --6-10,--.

Column 4, line 64, "tp" should read --top--.

Column 5, line 25, "polyethylene" should read --polyethylene,--.

UNITED STATES PATENT AND TRADEMARK OFFICE

CERTIFICATE OF CORRECTION

PATENT NO. : 4,784,269

DATED : November 15, 1988

INVENTOR(S) : William R. Griffith

It is certified that error appears in the above-identified patent and that said Letters Patent is hereby corrected as shown below:

Column 5, line 46, "used" should read --used,--.

Column 5, line 47 "tape" should read --tape,--.

Column 6, line 5, "section." should read --section,--.

Column 6, line 8, "discussed" should read --discussed,--.

Column 7, line 38, "wiich" should read --which--.

Column 7, line 48, "absorbiing" should read --absorbing--.

Signed and Sealed this

Twenty-seventh Day of June, 1989

*Attest:*

*Attesting Officer*

DONALD J. QUIGG

*Commissioner of Patents and Trademarks*